United States Patent [19]

Wolfgang et al.

[11] Patent Number: 4,823,587

[45] Date of Patent: Apr. 25, 1989

[54] ARRANGEMENT AND METHOD FOR COUPLING AND DECOUPLING GRIPPER RAIL PARTS IN A TRANSFER PRESS

[75] Inventors: Michael Wolfgang; Gerald Mikusch, both of Goeppingen; Eckhard Brangs, Bielefeld, all of Fed. Rep. of Germany

[73] Assignee: L. Schuler GmbH, Goeppingen, Fed. Rep. of Germany

[21] Appl. No.: 111,631

[22] Filed: Oct. 23, 1987

[30] Foreign Application Priority Data

Oct. 23, 1986 [DE] Fed. Rep. of Germany ..... 3636011

[51] Int. Cl.[4] ..... B21D 43/10

[52] U.S. Cl. ..... 72/405; 198/621; 403/349

[58] Field of Search ..... 72/405, 421, 422; 198/860.2, 621, 774; 403/348, 349

[56] References Cited

U.S. PATENT DOCUMENTS

| | | | |
|---|---|---|---|
| 1,431,513 | 10/1922 | Cox | 403/349 |
| 4,314,354 | 2/1982 | Felder et al. . | |
| 4,614,265 | 9/1986 | Glasberg | 72/405 |

FOREIGN PATENT DOCUMENTS

| | | | |
|---|---|---|---|
| 2624733 | 12/1977 | Fed. Rep. of Germany . | |
| 3233102 | 5/1983 | Fed. Rep. of Germany | 72/405 |
| 3323840 | 1/1984 | Fed. Rep. of Germany . | |
| 3437241 | 4/1986 | Fed. Rep. of Germany | 72/405 |
| 3501946 | 7/1986 | Fed. Rep. of Germany | 72/421 |
| 3511965 | 10/1986 | Fed. Rep. of Germany | 72/421 |
| 2166988 | 5/1986 | United Kingdom | 72/405 |

*Primary Examiner*—Dainel C. Crane

*Attorney, Agent, or Firm*—Barnes & Thornburg

[57] ABSTRACT

For coupling and decoupling gripper rail parts in a transfer press, clamping means with a clamping bolt movable in its axial direction and rotatable about the same are arranged in the end parts. The clamping bolt engages with a clamping anchor behind a clamping surface in the end part to be coupled. Centering means for the mutual alignment of the gripper rail parts and of coupling device for the lines taken along at the gripper rail parts are movable along with the clamping bolt. The closing of the coupling devices in the line leading to the clamping means takes place sequentially. The movements of the clamping bolts after the closing of the coupling devices can take place at the same time.

18 Claims, 5 Drawing Sheets

26
19
27
32
28
22
23
33
34
43
47
8
50
9
41
48
54
46
55
35
37
36
38
49
53
42
40
39
52
47
59
48
24
50
45
51
44
30
29
31

26
19
27
34
50
41
59
9
8
35
38'
38''
48
50
29
30

6,7
19
22
23
26
27
28
32
34
35
36
38
41
45
48
51
52
53
16
8
9
10
11
12
25'
25''
25'''
26'
26''
26'''
27'
27''
27'''

ARRANGEMENT AND METHOD FOR COUPLING AND DECOUPLING GRIPPER RAIL PARTS IN A TRANSFER PRESS

BACKGROUND AND SUMMARY OF THE INVENTION

The present invention relates to an arrangement for coupling and decoupling gripper rail parts in a transfer press with coupling means in the mutually coordinated end parts of the gripper rail parts to be coupled with one another and to be clamped together as well as to a method for coupling and decoupling such gripper rail parts with the use of such an arrangement.

In transfer presses, deformation presses or similar Presses, the workpieces are seized by gripping tools and are deformed in the working stations. The gripping tools are installed at gripper rails which may extend from the workpiece input station by way of the working stations up to the workpiece output station. Two gripper rails are present for a safe gripping and transporting of the workpieces, whereby the two gripper rails are movable spaced with respect to one another in the direction of the transfer movement of the workpieces, in the direction of a lifting and lowering in relation to the tool sets and in the direction toward and away from one another.

During the refitting of the press for a new workpiece, in addition to the exchange of the tool sets, also the gripping tools have to be replaced. The gripper rails are subdivided for that purpose into gripper rail parts remaining in the press and into interchangeable gripper rail parts. The exchange of tool sets and gripper rail parts takes place by way of sliding tables which are adapted to be movable out of the press and into the same.

The decoupling of the gripper rail parts from one another and the coupling of the same with one another is a partial operation of the exchange and is controlled in time by way of the central press control.

Memory programmable controls for the press automation in the manufacturing operation and for the installation operation are known, for example, from the publications DE-A1-26 24 733 and EP-B1 0 010 170 (U.S. Pat. No. 4,314,354 corresponding to the latter).

It is known from the DE-A1-33 23 840 to couple five gripper rail parts of the gripper rail with the assistance of couplings and to separate the same from one another. The gripper rail parts are thereby separated from one another in the longitudinal direction.

Furthermore, in a press with gripper rails for the transport of workpieces, the use of clamping elements in end parts of the gripper rail parts, with a respective clamping bolt movable in its axial direction and about the same, for clamping the gripper rail parts is also known (assignee's own construction). The clamping bolt is adapted to be extended out of a gripper rail part over the area of the separating place and is adapted to be fixed behind a clamping surface in the gripper rail part to be coupled. A shaped part is taken along together with the clamping bolt which is adapted to be inserted into an aperture in the gripper rail part to be coupled for centering the gripper rail parts with each other prior to the clamping. The supply of adjusting means and of inquiry units as well as of the control and shifting lines takes place by way of couplings connecting lines, on the one hand, between the press supports and the gripper rail parts remaining in the press and, on the other, between the mutually facing ends of the gripper rail parts. The couplings of the first-mentioned type must thereby be closed first in order to be able to close the couplings of the second-mentioned type. In the operating condition, the supply takes place by way of an energy feed by means of a drag cable between a respective press support and a respective gripper rail. The disengagement of the coupling takes place in reverse sequence also by corresponding signal transmission from the central press control The gripper rail parts are adapted to be restrained at the press supports, respectively, at the sliding tables by way of restraining means.

In contrast thereto, it is the task of the present invention to considerably reduce the periods of time for the decoupling and for the coupling of the gripper rail parts within the overall period of time for the exchange and to carry out simultaneously time-consuming operations.

The underlying problems are solved according to the present invention in that the movable parts of the centering means and one coupling half each for the lines are secured at a common bridge guided in an end part of a respective gripper rail part and in that the bridge is displaceably secured at the clamping bolt displaceable together with the same in and opposite the axial direction thereof. In the method according to the present invention, the underlying problems are solved by the following steps: coupling of the gripper rail parts by activating the first clamping means, as viewed from the energy supply for the gripper rails, for the advance of the clamping bolt up to the closing of the first coupling serving the energy supply of the second clamping means, activating the second clamping means for the advance of the clamping bolt up to the closing of the second coupling for the third clamping means, activating the third clamping means and possibly further clamping means up to the closing of the fourth and possibly further couplings in sequence, activating the clamping means for the further advance of the clamping bolts into a rotary position, activating the clamping means for the rotation of the clamping bolts through 90° in the rotary position, activating the restraining means for the disengagement of the restraining action between the press supports and gripper rail parts and between the sliding tables and gripper rail parts, simultaneously activating all clamping means for the retraction of the clamping bolts under abutment of the clamping anchors at the clamping surfaces of the gripper rail parts to be coupled and for pressing the gripper rail parts one against the other, and decoupling of the gripper rail parts in reverse sequence.

It is of particular advantage according to other further features of the present invention that all gripper rail parts are drawn together simultaneously into a gripper rail, and the gripper rail parts are pressed together after the rotation of all clamping bolts into the clamping position, and in that the gripper rail parts are decoupled simultaneously in a movement opposite thereto and are brought into a position spaced with respect to one another. The arrangement of all coupling-essential components on a common bridge not only reduces the number of subparts; instead, a high accuracy in the Positioning of the structural components and groups serving the centering and coupling is achieved thereby which are to be moved sequentially into engagement with the corresponding counterpieces.

It is additionally of advantage that the gripper rail parts are separated from one another in the simultaneous movement of the clamping bolts out of their abutment at the clamping surfaces into their rotary position, whereby the rotation of the clamping bolts can also take place simultaneously during the abutment at the countersurfaces at the gripper rail parts to be decoupled. The displacement travel of the clamping bolts can also be reduced in that the displaceable bridges are connected within the gripper rail parts with the clamping bolts, in which the clamping element is arranged. The number of the coupling elements is also considerably reduced by the arrangement of the clamping elements in the end part of the gripper rail parts opposite the energy supply. The arrangement of centering means and coupling halves within the end parts of the gripper rail parts reduces, in addition to the structural dimensions, the danger of damage during the support of the gripper rail parts on the sliding tables.

BRIEF DESCRIPTION OF THE DRAWINGS

These and other objects, features and advantages of the present invention will become more apparent from the following description when taken in connection with the accompanying drawing which shows, for purposes of illustration only, two embodiments in accordance with the present invention, and wherein.

DETAILED DESCRIPTION OF THE DRAWINGS

Figure 1:
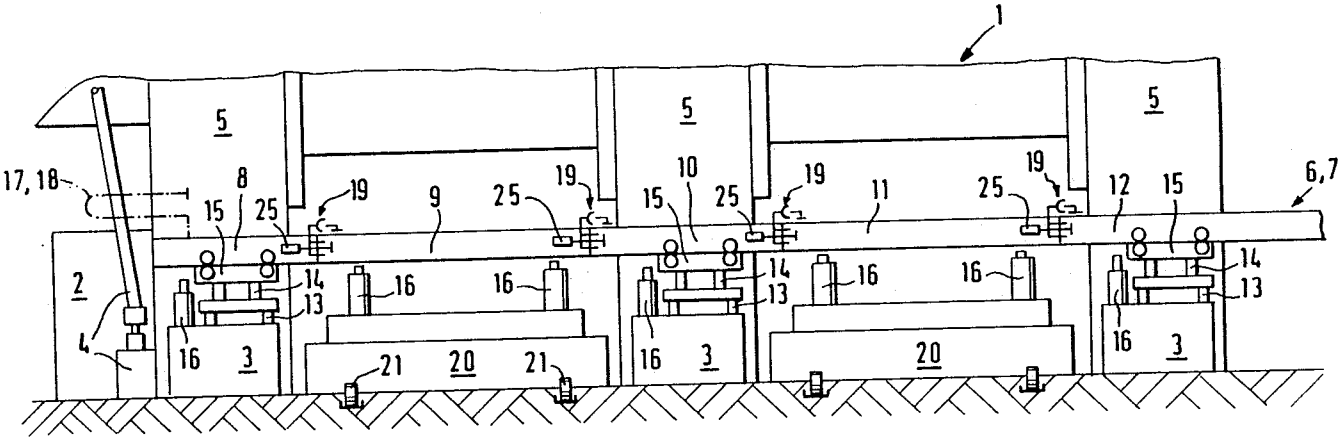
FIG. 1 is a side elevational view of a transfer press in accordance with the present invention within the area of the workpiece passage.

Referring now to the drawing wherein like reference numerals are used throughout the various views to designate like parts, gripper rails generally designated by reference numerals 6 and 7 are arranged in a press generally designated by reference numeral 1, for example, a transfer press in FIG. 1, of which only the gripper rail located in front in the viewing direction can be seen. The gripper rails 6 and 7, starting from a drive shaft and a transfer transmission 4, are movable or displaceable by way of an advance box 2 and closure boxes 3 in, for example, three axes, i.e., transfer, lifting-lowering and opening-closing. The devices therefor are only indicated schematically because these means are not important to the present invention and are known as such. A respective lifting-lowering installation is designated in each case by reference numeral 13, guide means of the opening-closing movement are designated by reference numeral 14 and means for the longitudinal movement of the gripper rails 6 and 7 are designated by reference numeral 15. The gripper rails 6 and 7 extend over the entire tool space and the input and output stations inside of press supports designated by reference numeral 5. Gripping tools are arranged at the gripper rails 6 and 7 for handling the workpieces. These gripping tools and further elements of the press 1, which may be of conventional construction and are not absolutely necessary for an understanding of the present invention, are also not illustrated for the sake of simplicity. The supply, for example, of the adjusting means for the gripping tools and further adjusting means, to be described more fully hereinafter, takes place by way of an energy input supply, indicated by two drag cables 17 and 18 shown in dash and dotted lines, which come from one of the press supports 5 and lead to the gripper rails 6 and 7.

The gripper rails 6 and 7 are subdivided into gripper rail parts 8, 10 and 12 which are located within the areas of the press supports 5, and into gripper rail parts 9 and 11 whose lengths are smaller than the spacing of the press supports 5 to one another. Slide tables 20 serve for the tool exchange as well as for the exchange of the gripping tools and of the gripper rail parts 9 and 11 carrying the same; the sliding tables 20 are adapted to be moved out of the press 1 and into the same on rails by way of guide rollers 21. Lifting cylinders arranged, on the one hand, within the area of the closing boxes 3 and on the other, at the sliding tables 20, serve for the support of the gripper rail parts 8 to 12 whereby the gripper rail parts 8 to 12 are adapted to be restrained or blocked at the piston rods of the lift cylinders 16. The separating places of the gripper rail parts 8 to 12 are designated by reference numeral 19. Coupling means are indicated within these areas, of which the respective clamping means is designated in FIG. 1 by reference numeral 25. The schematic illustration of these coupling means corresponds to those in FIGS. 4*a* to 4*e*.

Figure 2:
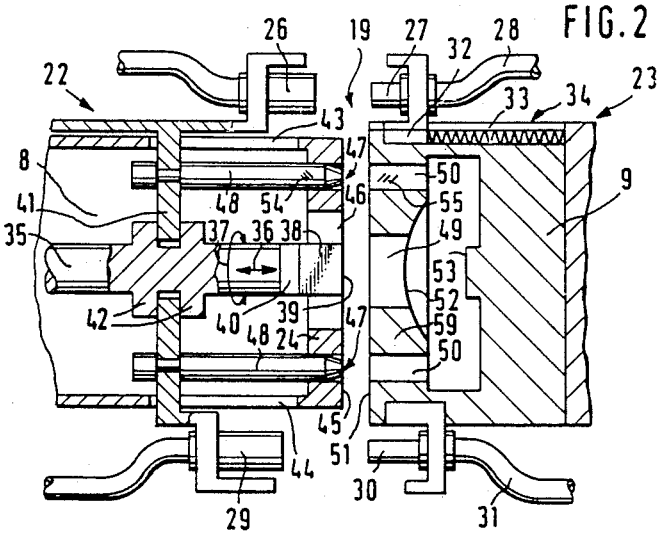
FIG. 2 is a cross-sectional view through the end area of a first embodiment of gripper rail parts to be coupled with each other in accordance with the present invention.
Figure 3:
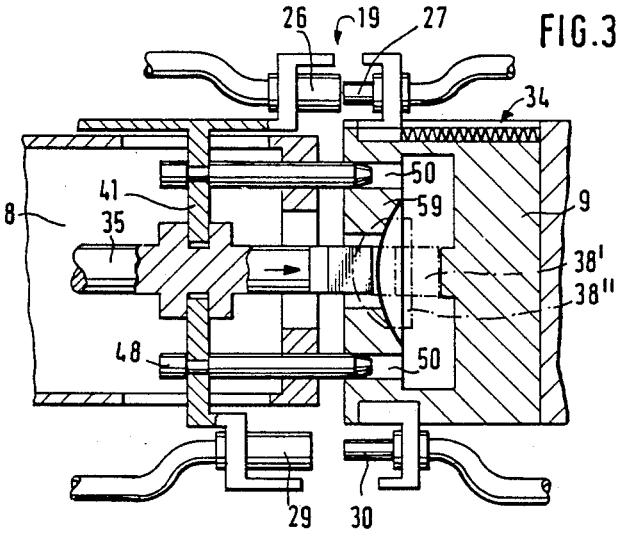
FIG. 3 is a cross-sectional view through the end area of the gripper rail parts according to FIG. 2 in a centering position.

Coupling means of a first embodiment are illustrated in FIGS. 2 and 3, which are installed in the end parts generally designated by reference numerals 22 and 23 of the gripper rail parts 8 and 9 and in a similar arrangement in the end parts 22 and 23 of the further gripper rail parts 10, 11 and 12. The end of a gripper rail part 8 to 11 opposite the drag cable 17, 18 is always designated by reference numeral 22. The coupling means include in the first instance a clamping means 25 in FIG. 1, which can move a clamping bolt 35 to and fro in the axial direction 36 thereof as well as rotate the same about the longitudinal axis in the direction of rotation 37, for example, through 90°. Such clamping means are commercially available under the designation of rotary clamping devices, rapid clamping systems and the like. The clamping bolt 35 includes in its end area a clamping anchor 38 which is adapted to be extended out of an aperture 46 in the flange 24. In its center area, the clamping bolt 35 is operatively connected in a securing area 42, for example, by way of adjusting rings with a bridge 41 in order to move the same along in its axial direction 36. It is understood that the securing area 42 can be realized also, for example, by a multi-partite construction of the clamping bolt 35 or by formed-on collars. The bridge 41 carries in edge areas centering bolts 48 which are guided in apertures 47 in the flange 24. The bridge 41 extends through apertures 43 and 44 in the walls of the end part 22 and carries in the protruding and cranked areas coupling halves 26 and 29. During a movement of the clamping bolt 35 in the axial direction 36, both the clamping anchor 38 as also the coupling halves 26 and 29 and the latter by way of the bridge 41 are moved to and fro. The end part 23 of the gripper rail part 9 is disposed opposite in the axial direction to the end part 22 of the gripper rail part 8. Openings 50 for the accommodation and for the guidance of the centering bolts 48 and a central opening 49 for the passage of the clamping bolt 35 together with the clamping anchor 38 are provided in the flange 59 of the end part 23. The clamping anchor 38 is adapted to be placed, on the one hand, with a correspondingly long movement in the axial direction 36 with an end face 39 against a gripper-rail-fixed countersurface 53 in the gripper rail part 9 and, on the other, after its rotation in the direction of rotation 37 through 90° and a movement opposite its advance movement in the axial direction 36, is adapted to be placed with an abutment surface 40 at its clamping anchor 38 against a clamping surface 52 at the inside of the flange 59. Owing to the tensional force of the clamping means 25, the flange surfaces 45 and 51 of the flanges 24 and 59 of the gripper rail parts 8, 9; 9, 10; 10, 11 as well as 11, 12 are then pressed against one another upon abutment of the clamping anchor 38 at the flange 59. Two coupling halves 27 and 30 are mounted at the end part 23 of the gripper rail part 9 which cooperate with the corresponding coupling halves 26 and 29 at the end part 22 in order to connect the lines 28 and 31 with each other in the separating places 19. Any energy and signal carriers of electric, hydraulic and/or pneumatic type are to be understood quite generally under the term "lines" in order to connect the energy loads, such as working cylinders and the like, adjusting means, inquiry means as well as shifting elements, for example, in valves, with the central press control. Surfaces at the centering bolts 48 and centering bores 50 are designated by reference numerals 54 and 55 whose distance in the separated condition, i.e., decoupled condition, of the gripper rail parts 8 to 12 is smaller than the distance of the couplings halves 26, 27 and 29, 30 to one another which connect the lines 28 and 31. The coupling half 27 is secured at a carriage 32 which is guided in a guide rail 33 and is adjustable against the effect of a spring 34, in this embodiment a compression spring, in the axial direction 36, respectively, in the movement direction of the bridge 41 and thus together with the coupling half 26. The spring 34 is so selected and designed that with the use of, for example, a hydraulic medium as energy carrier, at first closure members in one or both coupling halves 26 and 27 have to be displaced. For avoiding leakages, the displacement of the closure members thereby takes place after the closing of the coupling.

According to FIG. 3, the bridge 41 is illustrated displaced into an intermediate position by means of clamping means 25 and clamping bolts 35 during the movement for closing the coupling 26/27. The instant of time is thereby indicated in which the centering bolts 48 are introduced into the apertures 50 in the flange 59 and the gripper rail parts 8 and 9 are centered aligned with respect to one another in their end areas 22 and 23. An accurate alignment of the coupling halves 26 and 27 as well as 29 and 30 is assured thereby. For a better understanding of FIGS. 4*a* to 4*e*, the rotary position 38' as well as the clamping position 38'' of the clamping anchor 38 at the clamping bolt 35 are further indicated in FIG. 3.

Figures 4A, 4B:
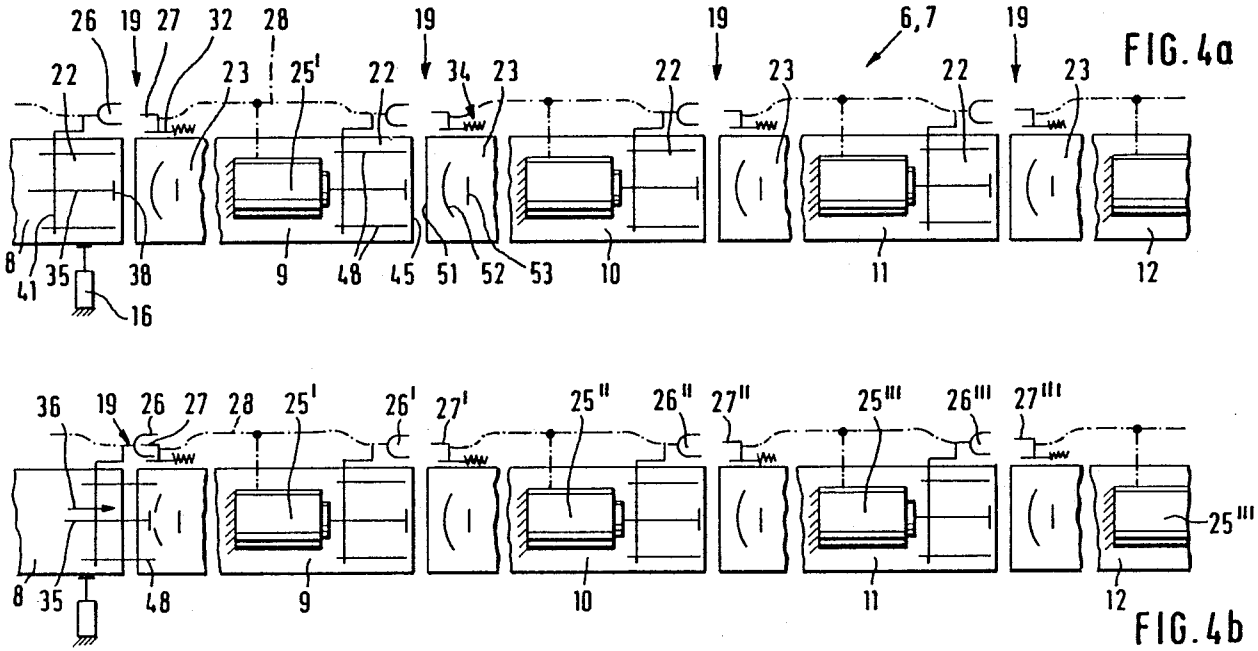
FIGS. 4*a–e* are schematic views illustrating the coupling operation—also the decoupling operation—of the gripper rail parts.

In FIGS. 4*a* to 4*e*, the same reference characters (numerals) are used as in FIGS. 1 to 3. However, the illustration of the components is shown simplified. The operations of the coupling and decoupling are to be illustrated on the basis of these figures The present invention is thereby predicated in the first instance on the concept to sequentially close the couplings 26/27 in the line 28, respectively, the lines 28 one after the other in order to permit, after reaching the coupled condition of the last coupling, all further time-consuming movements of the coupling and of the decoupling of the gripper rail parts 8 to 12 to be carried out at the same time, i.e., proceeding in parallel FIG. 4*a* illustrates the decoupled condition of all gripper rail parts 8 to 12 as well as of the couplings 26/27 (29/30). The gripper rail parts 8 to 12 are secured in the press, respectively, at the slide tables by means of the restraining means 16, of which one is indicated schematically. It is assumed that the energy input supply—by way of the drag cable 17, 18 in FIG. 1—takes place initially in the gripper rail part 8. Upon activation of the adjusting means 25 in the gripper rail part 8, a movement takes place by way of the clamping bolt 35 and the bridge 41 onto the centering bolts 48 and the coupling half 26. The position illustrated in FIG. 3 is passed over, which will lead to a closing of the coupling 26/27, illustrated in FIG. 4*b*. The carriage 32 still remains stationary under the action of the spring 34. The clamping bolt 35 can remain stationary or proceed into the rotary position illustrated in FIG. 3 and indicated by reference numeral 38'. With the closing of the first coupling 26/27, in the drawing always of the left coupling 26/27, the second coupling 26'/27' can be closed by way of the clamping means 25' connected to the line 28. With the closing of the second coupling 26'/27', the third coupling 26''/27'' can be closed by way of the clamping means 25'' connected to the line 28. As a result thereof, the connection to the clamping means 25''' is established, by way of which the coupling 26'''/27''' is to be closed. All further couplings, insofar as they are required by reason of the number of the press supports or columns, are to be closed in this sequence. The closing operation can be accelerated by further drag cables or by a drag cable in the center press support area which, however, is to be avoided, for example, for space reasons or for constructive reasons.

Figure 4C:
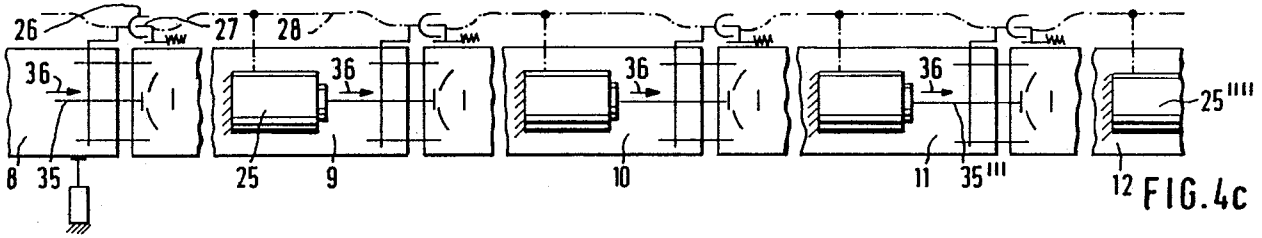

FIG. 4*c* illustrates the instant in the coupling phase, in which all couplings 26/27 connecting the line 28 are closed. All clamping bolts can now be moved simultaneously with the movement, not to be interrupted, of the (last) clamping bolt 35'', in the direction of the arrow 36 up to the rotary position 38' insofar as this movement has not already been carried out. The rotation 37 of the clamping bolts 35 can also have taken place already prior to rotation 37 of the (last) clamping bolt 35''' or simultaneously with the rotation thereof. The rotation takes place under abutment of the end surface 39 of the clamping bolts 35 at the counter-abutment surfaces 53 because for the decoupling operation to be described hereinafter, the gripper rail parts 8 to 12 have to be brought into this position anyhow. The rotary position of all clamping bolts 35 is illustrated in FIG. 4*d*.

Figure 4D:
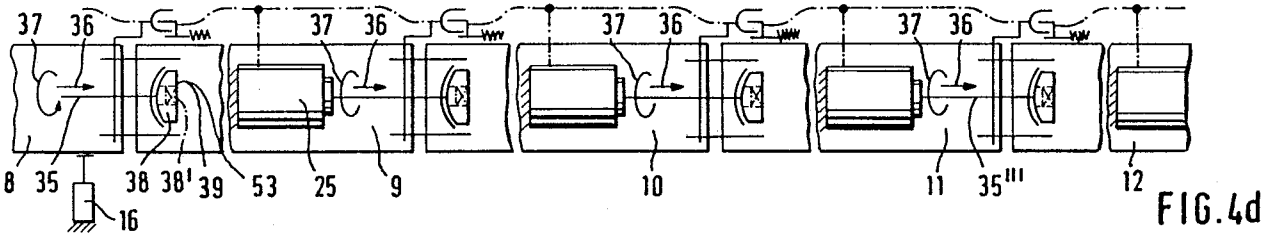
Figure 4E:
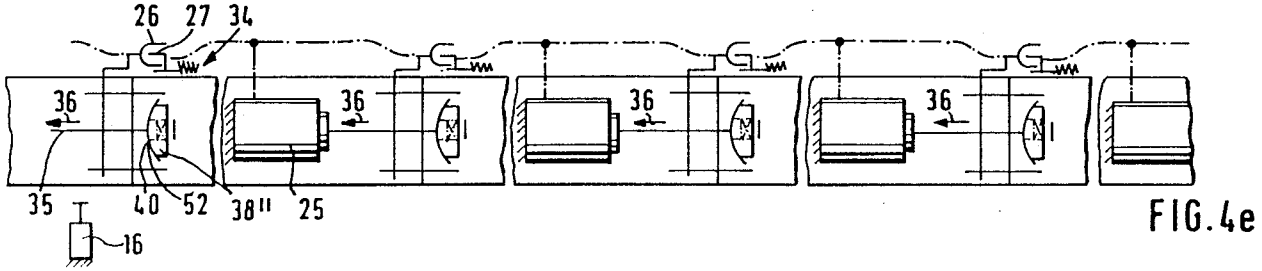

FIG. 4*e* illustrates the coupled condition of all gripper rail parts 8 to 12. This coupled condition is reached, starting from the position of the clamping bolts 35 in FIG. 4*d*, by a movement of the clamping bolts 35 in a direction 36 opposite the advance direction 36—FIG. 4*b* to 4*d*—, whereby the clamping bolt 35 remains rotated for the abutment of its abutment surface 40 at the clamping surface 52. Prior to clamping, all restraining means 16 in the areas of the press supports 5 and at the slide tables 20 are to be retracted from the gripper rail parts 8 to 12. The flange surfaces 45 and 51 designated in FIGS. 2 and 4*a* are pressed against one another. The couplings 26/27 which were displaced during the advance movement of the bridge 41 relative to the respective end part 23 of the gripper rail parts 9 to 12, are guided back into a center position during the clamping movement by way of the spring 34. The couplings 26/27 are under the effect of their springs 34 and thus maintain their required coupled condition. The coupling 29/30 illustrated in FIGS. 2 and 3 on the one hand permits a longer closing travel so that a compensating spring can be dispensed with. On the other hand, the coupling 29/30 is so adjusted that its coupled condition is attained with respect to time after the coupling of the coupling 26/27.

FIGS. 4*a* to 4*e* also illustrate at the same time the decoupling phases. Starting from FIG. 4*e*, the clamping means 25 are to be unclamped and are to be activated opposite the clamping direction which had taken place in the axial direction 36. The clamping bolt 35 is thereby displaced into its rotary position 38' under abutment of the end surface 39 whereby the gripper rail parts 8 to 12 and thus the flange surfaces 45 and 51 thereof are moved away from one another. The separating places 19 are enlarged to a spacing of the flange surfaces 45 and 51, illustrated in FIG. 4*d*, which is necessary in order to be able to remove the gripper rail parts 9 and 11.

Upon reaching the position of the gripper rail parts 8 to 12 shown in FIG. 4*d*, the latter are to be secured by way of restraining means 16 at the press 1, respectively, at the slide tables 20. The rotation of the clamping bolts 35 through a 90° angle into a position in which the clamping anchors 38 can be retracted out of the gripper rail parts 9 to 12, takes place simultaneously as also the unclamping of the clamping bolts 35 and the separating of the gripper rail parts 8 to 12. The couplings 29/30 which connect the lines 31 can be opened already during the separating phase. The retraction of all clamping bolts 35 takes place initially at the same time until the coupling 26/27 most remote from the energy input supply, drag cable 17, 18, for example, the coupling 26'''/27''' has opened. This, however, must take place only when the clamping anchor 38 is completely retracted into the gripper rail part 12 by way of the clamping bolt 35 of the clamping means 25'''' furthest remote from the energy input supply. In a similar manner, the clamping anchor of the clamping means 25'' can now be retracted under opening of the coupling 26''/27'', as a result of which the energy supply to the clamping means 25''' is interrupted. The opening of the further couplings 26/27 has to take place in this sequence which is reverse to the sequence during the closing of the couplings 26/27 because the energy supply takes place from one energy input side. The last coupling to be opened by way of the clamping means 25, in FIG. 4*b*, is thus the coupling 26/27 which is closest to the input supply, i.e., drag cable 17, 18. The adjusting movement during the separation of the gripper rail parts 8 to 12 from one another into the respective position until the respective coupling has to open, is compensated, respectively, bridged by the spring-loaded movement of the carriage 32.

Figure 6:
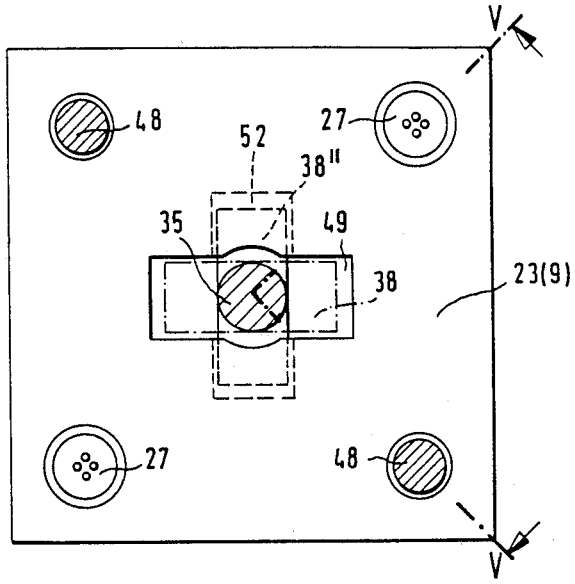
FIG. 6 is a cross-sectional view through the separating place taken along line VI—VI in FIG. 5.
Figure 5:
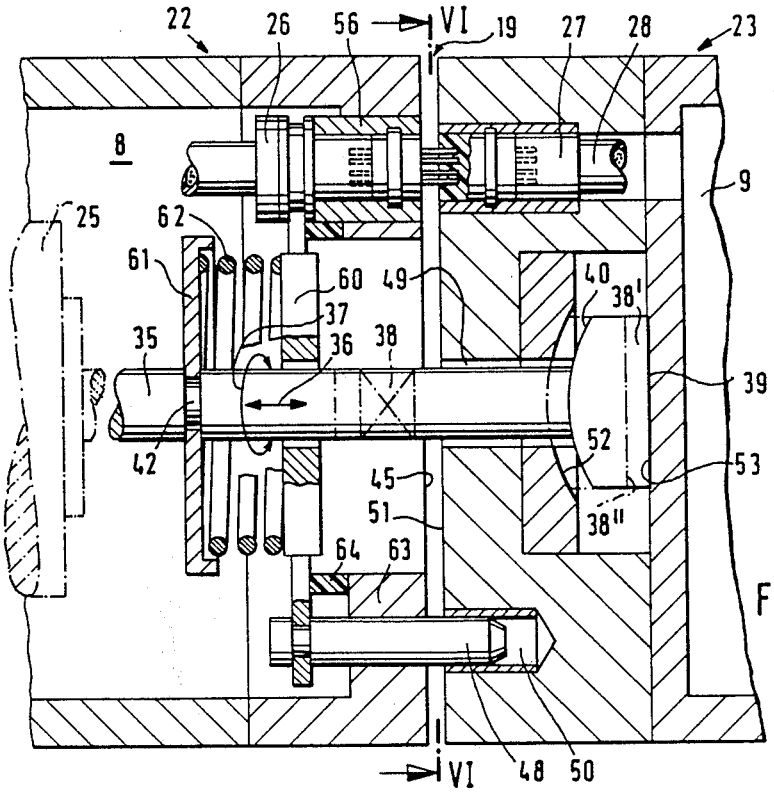
FIG. 5 is a cross-sectional view through the end areas of a further embodiment in accordance with the present invention of gripper rail parts to be coupled with each other, taken along line V—V in FIG. 6.

In FIGS. 5 and 6, the coupling halves 26 installed in the end parts 22 and 23 of the gripper rail parts 8 and 9 as well as the centering bolts 48 are attached at a carrier 60 which is supported by way of a spring force storage device 62, for example, a compression spring, at a bridge 61 movable in the axial direction 36 by the clamping means 25 by way of the clamping bolt 35. This bridge thereby engages, for example, in the securing area 42 into a groove at the clamping bolt 35 in order to indicate the rotatability in the bridge 61. The clamping bolt 35 is illustrated in its rotary position 38', in which the clamping anchor 38 abuts with the end face 39 at the counter-abutment surface 53. The clamping bolt 35 assumes this rotary position during the coupling before its abutment surface 40 is to be placed into abutment at the clamping surface 52. This position of the clamping beginning is indicated in dash and dotted lines and designated by reference numeral 38''. The coupling halves 27 are fixedly installed in the end part 23 and with their coupling side may terminate with the flange surface 51. The coupling halves 26 are fixedly arranged in a bushing 56 and are displaceably arranged together with the same in the end part 22 in the direction of movement of the carrier 60. Additionally, the aperture 49 for the clamping bolt 35 and the clamping anchor 38 can be seen in FIG. 6. The position 38 shows the rotary position of the clamping anchor in its position retracted into the end part 22. The coupling-decoupling movements take place in the manner described by reference to FIGS. 4*a* to 4*e*. FIG. 5 illustrates the instant in the coupling phase after the centering of the gripper rail parts 8, 9 and the beginning of the closing of the couplings 26/27. The coupling half 26 thereby terminates with its coupling side with the flange surface 48. The carrier 60 is guided against an elastic abutment 64, for example, a rubber-like buffer which is mounted on the collar 63. In the following movement of the clamping bolt 35, the relative movement between carrier 60 and bridge 61 is compensated by the spring force storage device 62, for example, by compression with the use of a compression spring.

While we have shown and described only two embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. An arrangement for coupling and decoupling gripper rail parts of gripper rail means for handling workpieces to move work to and from, as well as between, stations of a transfer press, comprising coupling means to couple and clamp gripper rail parts which are located in mutually coordinated end parts of the gripper rail parts to be coupled and clamped together when moving the workpieces to and from the press and uncoupled to allow movement between stations of the press, said coupling means including clamping means having a clamping bolt movable in a first axial direction relative to and longitudinally of a gripper rail part and rotatable about a centerline extending parallel to said axial direction and having a clamping anchor, said clamping anchor operable to be extended out of one gripper rail part over a separating space between gripper rail parts and adapted to be fixed behind a clamping surface in an end of another gripper rail part to be coupled, centering means for the mutual alignment of the gripper rail parts during coupling, restraining means for restraining the gripper rail parts at least during coupling and decoupling, and coupling devices for connecting energy line means carried with the gripper rail parts, said centering means including movable centering parts, the movable centering parts of the centering means and one half of the coupling devices for the energy line means being secured at a common bridge means guided in an end part of a respective gripper rail part, and said bridge means being secured to the clamping bolt means and displaceable together with the same.

2. An arrangement according to claim 1, wherein the clamping bolt means is operable to be moved to a position wherein a portion thereof, remote from the clamping means, abuts against a countersurface at the gripper rail part to be coupled and decoupled during a displacement of the clamping bolt means in the first axial direction.

3. An arrangement according to claim 1, wherein the displaceable bridge means is operatively connected with the clamping bolt in a gripper rail part having the clamping means.

4. An arrangement according to claim 1, further comprising energy input means for at least moving said clamping bolt means, and wherein each coupling means is arranged in an end part of each gripper rail part between the separating space and the energy input means.

5. An arrangement according to claim 1, wherein at the beginning of a coupling operation of two gripper rail parts, a spacing between a centering surface at the movable centering means and a fixed centering surface at the gripper rail part to be coupled is smaller than the said separating space between associated coupling halves of the coupling devices, and wherein the coupling halves of the coupling devices are operable to be brought into engagement with one another only when the centering of the gripper rail parts to be coupled has already taken place.

6. An arrangement according to claim 1, wherein the centering means and at least one coupling device for the energy line means are both arranged inside of end parts gripper rail parts to be coupled.

7. An arrangement according to claim 5, wherein the coupling devices and the energy line means for the clamping means are both arranged inside of the gripper rail parts to be coupled.

8. An arrangement according to claim 1, wherein the movable parts of the centering means and one half of the coupling devices for the energy line means of each separating space are both secured at a movable common carrier means guided in an end part of each gripper rail part, and wherein the common bridge means is secured to the clamping bolt and displaceable therewith, and wherein a spring force storage means is arranged between the carrier means and the bridge means for separatingly keeping apart the bridge means and the carrier means and for abutment of the carrier means at an abutment of the gripper rail part during the movement of the clamping bolt into the coupling and clamping position.

9. An arrangement according to claim 1, with slide cable means displacing tool sets and gripper rail parts to and from the transfer press, and wherein the restraining means are provided at a slide table means for supporting gripper rail part during periods of time when the tool sets for the gripper rail parts remain in the transfer press within an area of press support means and also for the time when gripper rail parts are to be moved between stations of the press.

10. An installation according to claim 1, wherein in each separating space a coupling half of the coupling device for connecting the energy line means is supported by a carriage means movable in the direction of the displacement of the bridge means at the respective gripper rail part to be coupled, and wherein a spring is arranged between the carriage means and the last-mentioned gripper rail part to effect holding of the carriage means opposite the coupling movement.

11. An arrangement according to claim 3, further comprising energy input means for at least moving said clamping bolt means, and wherein each coupling means is arranged in an end part of each gripper rail part between the separating space and the energy input means.

12. An arrangement according to claim 3, wherein at the beginning of a coupling operation of two gripper rail parts, a spacing between a centering surface at the movable centering means and a fixed centering surface at the gripper rail part to be coupled is smaller than the said separating space between associated coupling halves of the coupling devices, and wherein the coupling halves of the coupling devices are operable to be brought into engagement with one another only when the centering of the gripper rail parts to be coupled has already taken place.

13. An arrangement according to claim 6, wherein the centering means and at least one coupling device for the energy line means are both arranged inside of end parts of the gripper rail parts to be coupled.

14. An arrangement according to claim 13, wherein the coupling devices and the energy line means for the clamping means are both arranged inside of the gripper rail parts to be coupled.

15. An arrangement according to claim 14, wherein at the beginning of a coupling operation of two gripper rail parts, a spacing between a centering surface at the movable centering means and a fixed centering surface at the gripper rail part to be coupled is smaller than the said spacing separating space between associated coupling halves of the coupling devices, and wherein the coupling halves of the coupling devices are operable to be brought into engagement with one another only when the centering of the gripper rail parts to be coupled has already taken place.

16. An arrangement according to claim 15, wherein the displaceable bridge means is operatively connected with the clamping bolt in a gripper rail part having the clamping means.

17. An arrangement for coupling and decoupling plural gripper rail parts for handling workpieces to be moved toward and away from a press as well as between press stations and in which some gripper rail parts remain in the press and some gripper rail parts are operable to be exchanged with other exchangeable gripper rail parts, comprising clamping means in end portions of the gripper rail parts including clamping bolt means movable in a longitudinal axial direction of and relative to respective gripper rail parts and rotatable about a line extending parallel to said axial direction, said clamping bolt means being operable to engage with a clamping anchor means behind a clamping surface in another respective gripper rail part to be coupled or decoupled to the gripper rail part having said end portion, centering means for the mutual alignment of the gripper rail parts to be coupled or decoupled, coupling means for connecting energy line means carried with the gripper rail parts, bridge means connected to and moving said centering and coupling means with said clamping bolt means, and means for sequentially closing the coupling means in the energy line means leading to the clamping means of plural rail parts.

18. An arrangement according to claim 17, further comprising means for simultaneously moving all the clamping bolt means after closing the coupling means in the energy line means leading to the clamping means in the last of the plural rail parts to be coupled.

* * * * *